US005587097A

United States Patent [19]

Sato et al.

[11] Patent Number: 5,587,097

[45] Date of Patent: Dec. 24, 1996

[54] FIXING HEATER AND METHOD OF MANUFACTURING FIXING HEATER

[75] Inventors: Shigehiro Sato, Yokohama; Yoshiyuki Matsunaga, Yokosuka; Tsuyoshi Ono, Tokyo; Takaaki Karube, Yokohama, all of Japan

[73] Assignee: Toshiba Lighting & Technology Corporation, Tokyo, Japan

[21] Appl. No.: 274,367

[22] Filed: Jul. 13, 1994

Related U.S. Application Data

[63] Continuation of Ser. No. 987,600, Dec. 9, 1992, abandoned.

[30] Foreign Application Priority Data

| | | | |
|---|---|---|---|
| Dec. 9, 1991 | [JP] | Japan | 3-324791 |
| Feb. 27, 1992 | [JP] | Japan | 4-041327 |
| Mar. 31, 1992 | [JP] | Japan | 4-108733 |

[51] Int. Cl.[6] ..... H05B 3/16

[52] U.S. Cl. ..... 219/543; 219/216; 219/121.68

[58] Field of Search ..... 219/121.6, 121.68, 219/121.69, 121.85, 216, 543; 338/195, 217, 285, 307, 308, 309; 29/611, 620; 355/285, 289, 290

[56] References Cited

U.S. PATENT DOCUMENTS

| | | | |
|---|---|---|---|
| 4,374,314 | 2/1983 | Deacutis | 219/121.68 |
| 4,403,133 | 9/1983 | Turner et al. | 338/195 |
| 4,772,774 | 9/1988 | Lejeune et al. | 338/195 |
| 4,897,520 | 1/1990 | Carter et al. | 219/121.68 |
| 5,068,517 | 11/1991 | Tsuyuki et al. | 219/543 |
| 5,162,635 | 11/1992 | Sato et al. | 219/216 |
| 5,267,005 | 11/1993 | Yamamoto et al. | 355/290 |

FOREIGN PATENT DOCUMENTS

| | | |
|---|---|---|
| 0295901 | 12/1988 | European Pat. Off. . |
| 265086 | 3/1990 | Japan . |
| 2186585 | 7/1990 | Japan . |

OTHER PUBLICATIONS

"Laser Trimming of Silicon–Chromium Thin–Film Resistors" Fehlhaber, Solid State Technology pp. 33–36, Jul. 1971.

*Primary Examiner*—Teresa J. Walberg
*Assistant Examiner*—Gregory L. Mills
*Attorney, Agent, or Firm*—Oblon, Spivak, McClelland, Maier & Neustadt, P.C.

[57] ABSTRACT

A fixing heater comprises a substrate having an insulative property and a heat generating member with electrical resistance printed on a surface of the substrate. The heat generating member is a film-like shape having a direction and a pair of edge portions opposing one another, wherein one of the edge portions is trimmed in the direction. The heat generating member has a heat generating portion having opposing one and another edge portions, wherein one of the edge portions is trimmed in the direction throughout the heat generating portion. The heat generating portion is trimmed so as to provide the trimmed edge having partially different width along the direction. The fixing heater is manufactured by trimming one edges of the heat generating member in the direction throughout the heat generating portion and further trimming the trimmed edge on the basis of an amount of a resistance value change of the heat generating member before and after or during the former trimming step to obtain a predetermined resistance value or resistance value distribution. The triming steps are performed by means of laser beam. A generating temperature controlling portion may be formed to the heat generating member.

8 Claims, 5 Drawing Sheets

FIXING HEATER AND METHOD OF MANUFACTURING FIXING HEATER

This application is a Continuation of application Ser. No. 07/987,600, filed on Dec. 9, 1992, now abandoned.

BACKGROUND OF THE INVENTION

The present invention relates to a fixing heater used for fixing toner image in a copying machine, for example, and also relates to a method of manufacturing the same.

In a conventional technology, a fixing heater used for fixing toner image in a copying machine, for example, is produced by applying a paste of, for example, a silver-palladium alloy powder on the surface of an elongated substrate such as ceramics as shown in FIG. 9 and then firing the applied paste.

For the heat fixing of the toner image, a uniform temperature application is generally required such as of 200° C. with less allowance of about 10° C. In this type of fixing heater, it is necessary that a resistance value of a film-like heat generating member 2 is adjusted to fall within a predetermined range so as to obtain a constant heat generation rate when a predetermined level of electrical current is applied. In the conventional technology, such adjustment of the resistance value has been done by varying a sheet resistance value of the heat generating member 2 by varying the amount of the conductive paste constituting the material of the heat generating member 2 and being printed to a substrate 1, i.e. the size of the heat generating member or by selecting the material of the conductive paste.

However, in this conventional technology, the resistance adjustment method has to be performed before the firing for the print of the heat generating member. Thus, it has not been allowed to effect a fine readjustment after the firing, which makes it difficult to obtain a desired resistance value and, hence, causes a large variation or fluctuation of a generated temperature of a fixing heater as a product.

In a conventional technology, there has been also proposed a method in which, as shown in FIG. 10A, a resistor is printed in a manner used in ordinary hybrid ICs (integrated circuits) and the resistor as the heat resisting member 2 is then subjected to triming so as to provide a key-like shape by using a laser, for example. However, a mere application of the laser triming treatment to the fixing heater produces a temperature distribution as shown in FIG. 10B in which heat generation is locally increased at the trimmed portion, resulting in a cause of non-uniform fixing. Thus, such conventional technology is not available for fixing the toner image in a copying machine.

SUMMARY OF THE INVENTION

An object of the present invention is to substantially eliminate defects or drawbacks encountered in the prior art and to provide a fixing heater, particularly, for fixing toner image in a copying machine, for example, capable of obtaining a desired resistance value of the fixing heater and a desired distribution of the resistance value thereof, and also provide a method of manufacturing such fixing heater.

Another object of the present invention is to provide a fixing heater, particularly, for fixing toner image in a copying machine, for example, capable of obtaining a desired distribution of a generated temperature of the fixing heater.

These and other objects can be achieved according to the present invention by providing, in one aspect, a fixing heater comprising:

a substrate having an insulative property; and a heat generating member with electrical resistance printed on a surface of the substrate, the heat generating member being a film-like shape having a direction and a pair of edge portions opposing one another along the direction, wherein one of the pair of edge portions is trimmed along the direction.

The heat generating member is trimmed so as to provide the trimmed edge portion having partially different width along the direction, i.e. current flowing direction.

In another aspect, there is provided a fixing heater comprising:

a substrate having an insulative property; and a heat generating member with electrical resistance printed on a surface of the substrate, the heat generating member being a film-like shape having a heat generating portion having a direction and a pair of edge portions opposing one another along the direction, wherein one of the pair of edge portions is trimmed along the direction throughout the heat generating portion of the heat generating member.

Electrodes are further disposed in contact with end portions of the heat generating member.

In a further aspect of the present invention, there is provided a method of manufacturing a fixing heater comprising the steps of:

preparing a substrate;

printing a heat generating member on a surface of the substrate, the heat generating member having a heat generating portion having a direction and a pair of edge portions opposing one another; and trimming one of the pair of edge portions for changing value of electrical resistance along the direction throughout the heat generating portion.

The method further comprises the step of further triming the trimmed edge portion on the basis of an amount of resistance value change of the heat generating member before and after the former trimming step to obtain a predetermined resistance value. The method may further comprise the step of further triming the trimmed edge portion on the basis of an amount of resistance value change of the heat generating member during the former trimming step to obtain a predetermined distribution of the resistance value.

The triming steps are performed by means of a laser beam.

In a still further aspect of the present invention, there is provided a fixing heater comprising:

a substrate having an insulative property;

a heat generating member with electrical resistance printed on a surface of the substrate, the heat generating member being a film-like shape having a heat generating portion having a direction and a pair of edge portions opposing one another along the direction, wherein one of the pair of edge portions is trimmed along the direction throughout the heat generating portion of the heat generating member; and means provided for the heat generating member for controlling a distribution of a temperature to be generated, the controlling means being formed to another edge portion of the heat generating portion. The temperature controlling means is formed by reducing a width of the heat generating portion at portions near the end portions of the heat generating portion of the heat generating member.

In a still further aspect, there is provided a fixing heater comprising:

a substrate having an insulative property;

a heat generating member with electrical resistance printed on a surface of the substrate, the heat generating member being a film-like shape having a direction and a pair of edge portions opposing one another edge portions; and powder adhering on the surface of the substrate along the direction, the powder being composed of the same material as that of the heat generating member.

One of the pair of edge portions of the heat generating member is trimmed along the direction and the powder is formed of the material of the heat generating member fused and spattered by the laser-triming treatment.

In a still further aspect, there is provided a fixing heater comprising:

a substrate having an insulative property;

a heat generating member with electrical resistance printed on a surface of the substrate, the heat generating member being a film-like shape having a heat generating portion having direction and a pair of edge portions opposing one another edge portions; and powder adhering on the surface of the substrate along the direction throughout the heat generating direction, the powder being composed of the same material as that of the heat generating member.

According to the present invention of the characters described above, the heat generating member of the film-like form is gradually trimmed along the edge of the heat generating portion of the heat generating member under the observation of the change of the resistance value, so that the fixing heater having a desired distribution of generated temperature can be obtained, thus precisely setting the generating temperature of the fixing heater as a product. The location of the temperature controlling portion to the heat generating member can enhance the desired distribution of the temperature. The thus manufactured fixing heater is particularly applicable for the fixing of the toner image in a copying machine, for example, in which substantially constant generated temperature distribution is highly required.

The further natures or features of the present invention will be made more clear hereunder in conjunction with the accompanying drawings.

DESCRIPTION OF THE PREFERRED EMBODIMENTS

One preferred embodiment of a fixing heater according to the present invention will be described hereunder with reference to FIGS. 1 and 2.

Figure 1A:
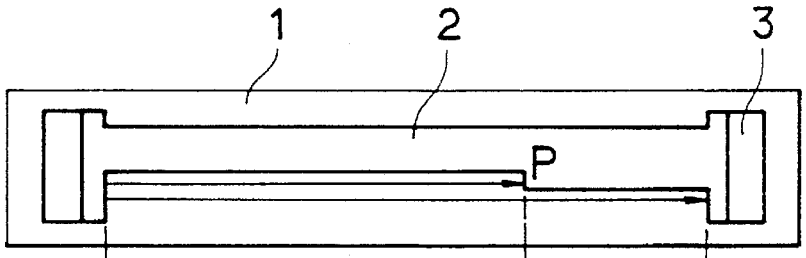
FIG. 1A is a illustrated plan view of a first embodiment of a fixing heater according to the present invention.

FIG. 1A is a general view showing a construction of a fixing heater, and the fixing heater comprises a substrate 1 having an insulating property which is made of, for example, alumina $Al_2O_3$, a heat generating member 2 in the form of a film disposed on a surface of the substrate 1 and electrodes 3 disposed to both ends of the heat generating member 2.

The heat generating member 2 is formed by screen printing a paste containing powder of a silver-palladium alloy and then firing the same. The electrodes 3 are formed to both the longitudinal end portions of the film-like heat generating material 2 also by screen printing a paste containing highly conductive metal such as silver and then firing the paste.

According to the present invention, the heat generating member 2 is subjected to a laser-trimming treatment, as described hereinlater, in a direction of the flow of electrical current along an edge of the heat generating member 2 as indicated by an arrow in FIG. 1A. Namely, one and the other ends of a heat generating portion of the heat generating member 2 are recognized by an ordinary image identification apparatus, for example, and then, one edge of the heat generating portion is trimmed by means of laser at a constant width in the direction of the current flowing, while measuring a rsistance value between the electrodes 3 by an ordinary device. This laser-trimming is repeated till the measured resistance value falls within a predetermined range.

Figure 1B:
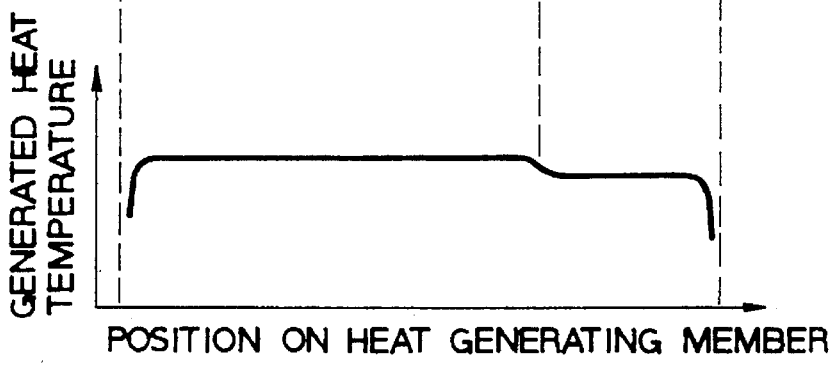
FIG. 1B is a graph showing a distribution of a temperature generated of the fixing heater of FIG. 1A.

The fixing heater thus formed exhibits the desired resistance value since the adjustment of the resistance value is conducted after the printing and firing processes. In addition, since the adjustment is conducted by the later-trimming effected along the edge of the heat generating member 2 in the current flowing direction, any substantial unevenness of the temperature distribution, attributable to the trimming, can be effectively avoided as shown in FIG. 1B.

Figure 2A:
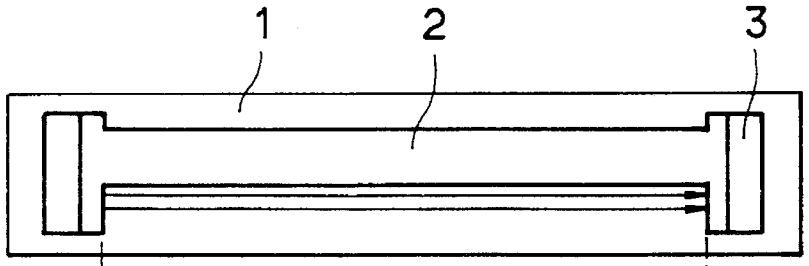
FIG. 2A is a view similar to that of FIG. 1A, but related to a second embodiment of the present invention.

In the described embodiment, the laser-trimming has been completed at a portion P between both the electrodes 3 attached to the heat generating member 2 as viewed in the current flow direction. This, however, is only illustrative and the temperature distribution can be further made uniform by effecting evenly trimming the edge of the heat generating member 2 in the direction of flow of the electric current as shown in FIG. 2A.

More specifically, as the first step of the laser-trimming, the trimming is effected at a constant width on one edge of the heat generating portion of the heat generating member 2 extending in the current flow direction from one end of the heat generating portion identified by an image recognizing device, for example, towards the other end thereof. The change in the resistance value is then detected by comparing the resistance value between the electrodes 3 as measured before the trimming and that as measured after the trimming.

Then, the width of the heat generating portion for the second trimming step is calculated by, for example, a computer on the basis of the change in the resistance value, and the second trimming is effected on the portion of the heat generating member 2 between the electrodes 3 on the basis of the calculated result so as to trim the heat generating member 2 from one end to the other end thereof in the current flow direction at the width determined by the calculation.

Figure 2B:
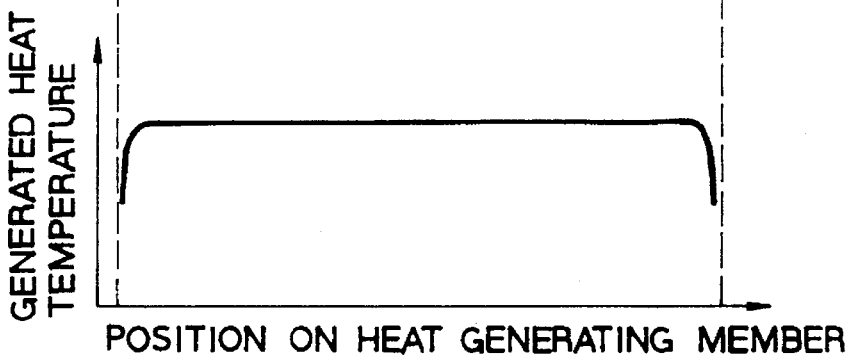
FIG. 2B is a graph showing a distribution of a temperature generated of the fixing heater of FIG. 2A.

According to the described method, it is possible to accurately attain the desired resistance value. In addition, since there is no abrupt change in the configuration of the edge of the heat generating member, any substantial unevenness of the temperature distribution due to the trimming can be effectively avoided as will be seen from FIG. 2B showing the result of an experiment carried out in accordance with the method described above according to the present invention.

A repeated durability tests were conducted on the fixing heater of the described embodiment by subjecting it to heat generating cycles each including continuous fifteen (15) seconds of power supply followed by five (5) second suspension of power supply. No abnormality was found in the heat generating performance even after more than 100,000 consecutive heating cycles, thus proving superiority of the fixing heater for the fixing of the toner image, for example, of the present invention.

In the described embodiment, although a heat generating member having a rectangular shape is employed, the heat generating member can have any other suitable form with its edge trimmed in the current flow direction by means of, for example, laser beams.

Figure 3:
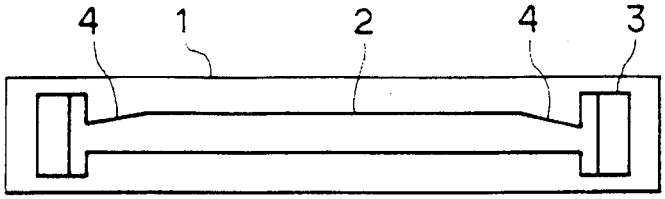
FIG. 3 is a view similar to that of FIG. 1A, but related to a third embodiment of the present invention.

FIG. 3 shows another embodiment of the present invention, in which the fixing heater is further provided with a temperature controlling means for controlling the distribution of the temperature to be generated of the heat generating member 2. Referring to FIG. 3, the heat generating member 2 has portions 4 having width reduced in the width direction thereof, the portions 4 being formed to the heat generating member 2 at the ends of another edge thereof, other than the edge to which the trimming is effected, near the electrodes 3. The location of the reduced width portions 4 of the heat generating member 2 serves to increase the heat generating amount at the end portions thereof at which the heat generation is likely lowered, thus improving the generated temperature distribution to be more uniform. Of course, the temperature controlling means such as portions 4 may be applied to the other portions along the other edge of the heat generating member 2 as occasion demands.

Figure 4:
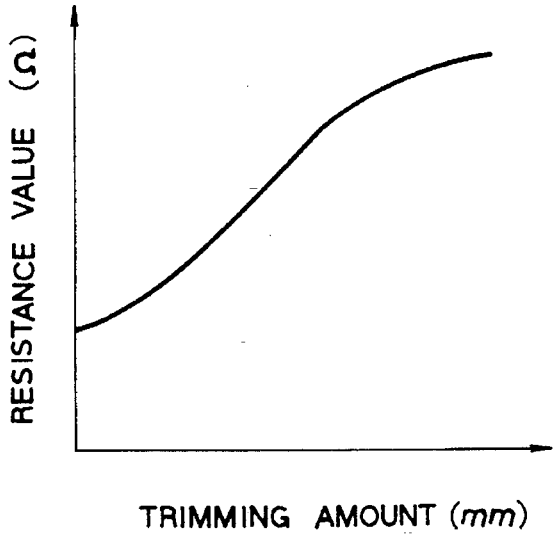
FIG. 4 is a graph showing a relationship between the resistance value and the amount of the trimming.

In the described embodiments, when it is required to manufacture of a fixing heater having a uniform resistance value distribution, one edge of the heat generating member 2 is trimmed throughout the longitudinal direction, i.e. current flowing direction, with a cut width of about 5% of the total width thereof, and thereafter, the change of the resistance value and the amount of the trimming are measured to thereby obtain the distribution of the resistance value between the electrodes 3 disposed at longitudinal end portions of the heat generating member 2, as shown in FIG. 4. Under the observation of this resistance value distribution, the trimming may be further effected to increase the trimmed amount to compensate for a portion at which the change of the resistance value is small, that is, a portion having a low resistance value with respect to a unit area in view of the resistance value distribution. In this manner, the trimming amount is timely changed to thereby manufacture the fixing heater having a desired distribution of the resistance value.

Figure 5A:
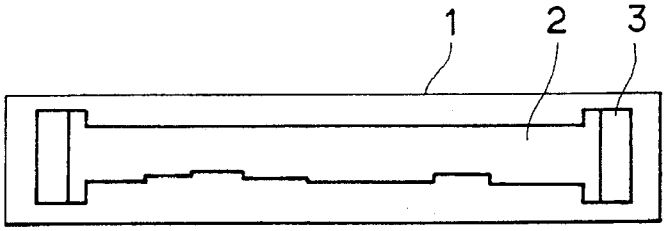
FIG. 5A is a view similar to that of FIG. 1A, but related to a fourth embodiment of the present invention.
Figure 5B:
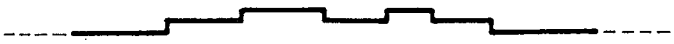
FIGS. 5B and 5C show enlarged views showing examples of the shapes of further trimmed portions of the heat generating member in connection with the fixing heater of FIG. 5A.
Figure 5C:
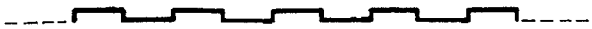

In this and other connection, FIG. 5A shows a further embodiment of the fixing heater of the present invention, in which the laser-triming is first effected in uniformly along the current flowing direction to one edge of the heat generating member 2. In consideration of the desired distribution of the resistance value, a further laser-trimming may be carried out. FIGS. 5B and 5C are examples of the trimmed shape of the edge portion by means of the laser, and the possibility of such shapes will be understood from the fact that the laser trimming is effected spot-likely as nature of the laser beam.

Figure 6A:
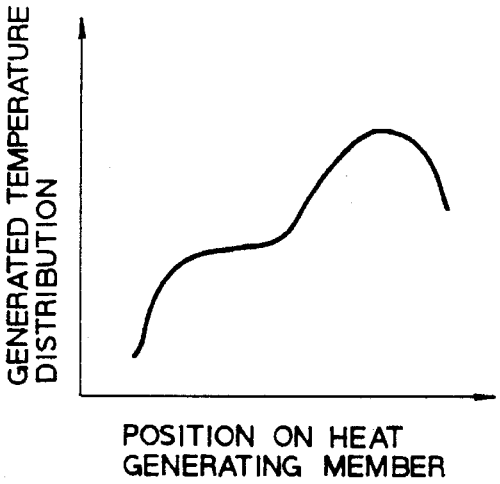
FIGS. 6A and 6B are graphs showing relationship between the distribution of the temperature generated and the position of the heat generating portion of the heat generating member before and after the trimming treatment, respectively.
Figure 6B:
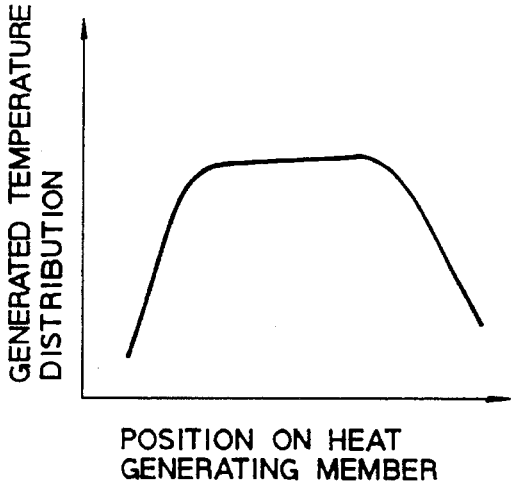

According to the embodiments of the present invention, the generated temperature distribution on the surface of the heat generating member 2 is amended from a state such as shown in FIG. 6A to a state shown in FIG. 6B showing the uniform distribution of the temperature to be generated after the trimming operation.

Figure 7A:
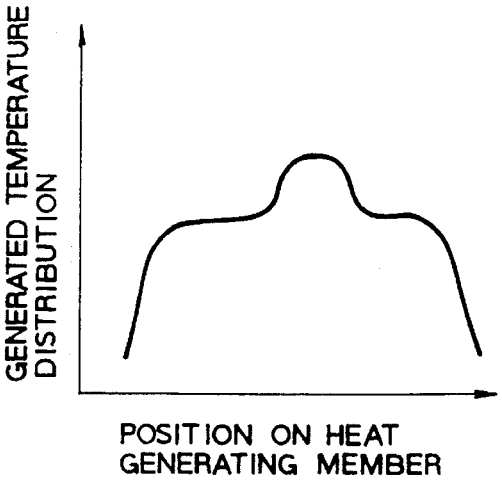
FIGS. 7A and 7B are graphs showing relation ship between the temperature distribution characteristics and the heating positions of the heat generating member.
Figure 7B:
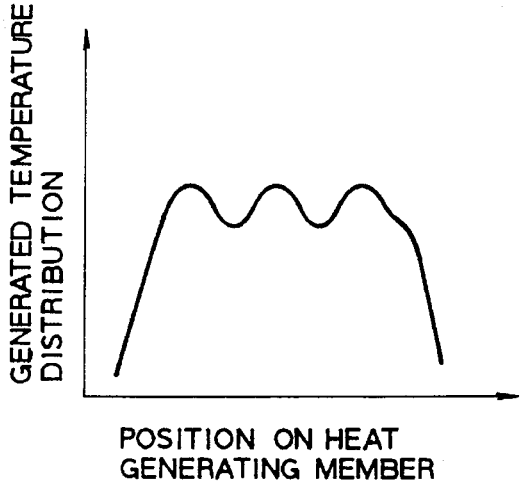

Furthermore, in a case where it is desired to manufacture fixing heaters having specific temperature distributions such as shown in FIGS. 7A and 7B, such fixing heaters can be manufactured by changing the trimming amount of the heat generating member, and such control can be done easily under the control of a computer, for example. FIG. 7A shows a case in which the axially central portion of the fixing heater has a high temperature distribution and FIG. 7B shows a case in which the fixing heater has a waved temperature distribution along the axial direction thereof, i.e. the current flowing direction.

Figure 8A:
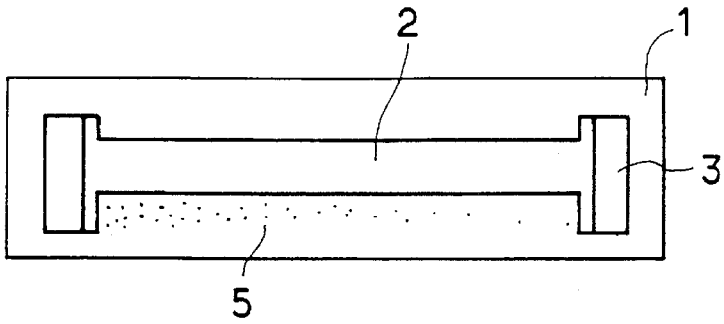
FIGS. 8A and 8B are views showing further embodiments of the fixing heater according to the present invention.
Figure 8B:
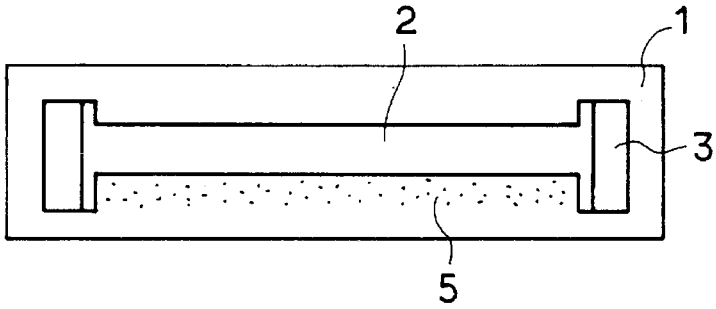
Figure 9:
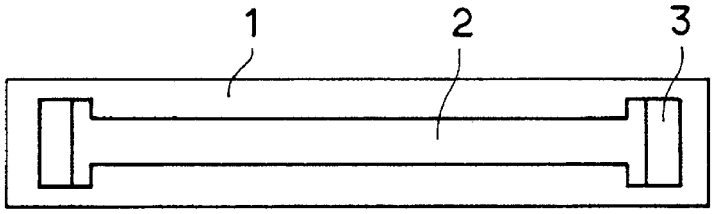
FIG. 9 PRIOR ART
FIG. 9 shows an illustrated plan view of a fixing heater of the conventional structure.
Figure 10A:
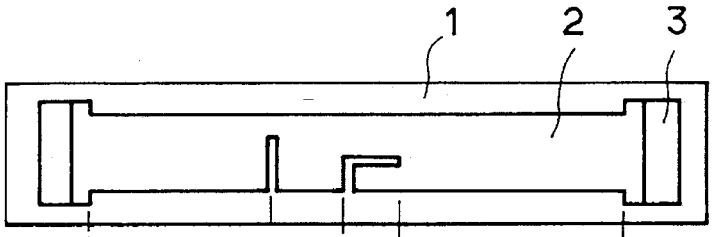
FIG. 10A is a view showing a structure of another type fixing heater of the prior art and FIG. 10B shows a graph of the distribution of the temperature generated of the fixing heater of FIG. 10A.
Figure 10B:
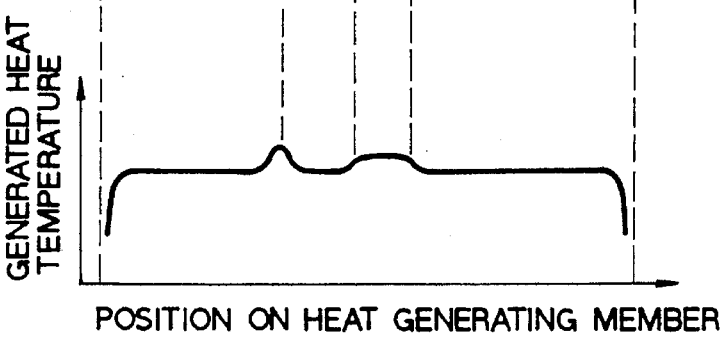
FIG. 10B PRIOR ART
Figure 11:
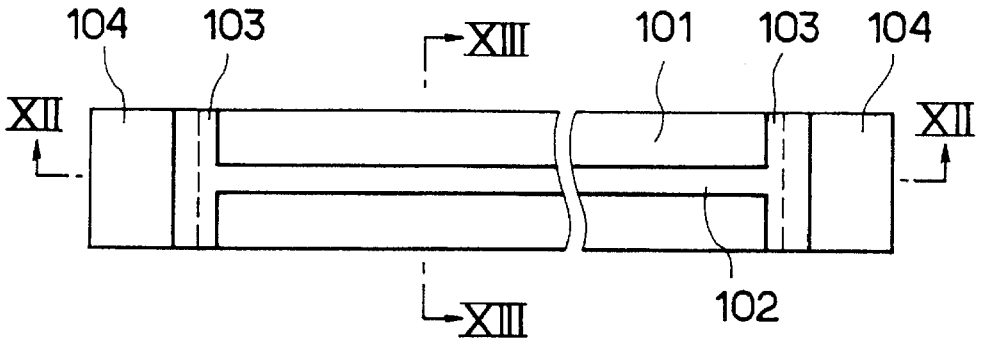
FIG. 11 is a plan view of a fixing heater according to still further embodiment of the present invention.
Figure 12:
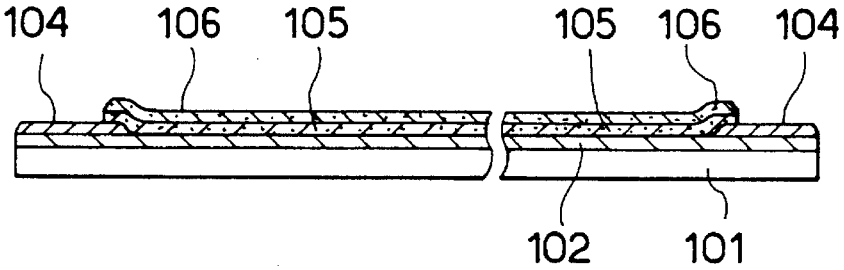
FIG. 12 is a sectional view taken along the line XII—XII of FIG. 11.

FIGS. 8A and 8B show still further embodiments of the fixing heaters according to the present invention, in which dust or powder like materials 5 adhere on the surface of the substrate 1 along the current flowing direction of the heat generating member 2 on the edge portion thereof as shown in FIG. 8A, and the materials 5 adhere on the edge portion of the heat generating member 2 along the full length of the heat generating portion thereof as shown in FIG. 8B. These mateials 5 are of the same substance as that forming the heat generating member 2 and are generally composed of the material of the heat generating member 2 fused during the laser trimming process.

Furthermore, although the described embodiments employs a paste containing a silver-palladium alloy as the material of the heat generating member, this is only illustrative and the paste may contain other metals such as nickel or tin. The electrode material also may be replaced with one of other metals which are widely used.

It is also possible to print and fire a glass paste on the heat generating member so as to form a protective film which protects the heat generating member.

In this and other connection, another aspect of the fixing heater according to the present invention may be applied to a fixing heater having a surface covered by a glass layer. The glass layer is applied for the purpose of achieving a function to prevent abrasion of the heater due to rubbing by copy paper sheets which carry the toner and which move in contact with the surface of the fixing heater as well as a function to ensure the smooth sliding of the copy paper sheets and a function to ensure the electrical insulation thereby preventing leak of the electrical current flowing in a heat generating resistor. The cover glass for the known fixing heaters, however, could not satisfactorily achieve these three functions. This is because no material for the cover glass which would satisfactorily perform these three functions has been available. In fact, no such cover glass material has been discovered up to now.

The above described problem encountered in the prior art will be solved according to the present invention by providing a fixing heater of the characters or structures described hereunder with reference to preferred embodiments.

Referring to FIGS. 10 to 13, a substrate 101 is made of a heat resistant alumina ceramics such as $Al_2O_3$ and has a rectangular tubular form of about 270 mm length, 7 mm width and 1 mm thickness. A heat generating layer 102. A heat generating resistor layer 102 is formed at a thickness of about 10 μm by applying and firing an electrically conductive paste on the substrate 101 in the longitudinal direction of the latter, the electrically conductive paste being a silver-palladium alloy (Ag/Pd) or a silver-palladium alloy containing ruthenium oxide ($Ag/Pd+RuO_2$). The paradium contained in the alloy serves as a resistance element so that the resistance value of the heat generating resistor is determined by the content of palladium. In the illustrated embodiment, the heat generating resistor has a resistance value of 34Ω, and allows a current of 100 V, thus generating heat of 300 W. Both ends of the heat generating resistor 102 are widespread so as to provide electrode forming portions 103. Heat generated by the portion of the heat resistor layer 102 other than the electrode forming portions 103.

An electrode layer 104 for connection to an external electrode is formed on the surface of the electrode forming portion 103 on each end of the heat generating resistor 102. The electrode layer 104 is provided for the purpose of obtaining contact electric resistance smaller than that of the heat generating resistance layer 102, and is formed form a paste of a metal such as silver (Ag), silver-platinum alloy (Ag/Pt), gold (Au) and platinum (Pt). That is, the above-mentioned metal paste is applied to and fired on each electrode forming portion (103), after formation of the whole heat generating resistor layer 102 including both terminal forming portions 103, thus obtaining the electrode layer 104 of about 10 μm thick on each end of the heat generating resistor layer 102.

The surface of the web portion of the heat generating resistor layer 102 is coated by a glassy material having high electrical insulation power which forms an insulating glass layer 105. The insulating glass layer 105 is made of a material mainly composed of borosilicate glass, e.g., an insulating glass paste PLS 3310 produced by Nippon Denki Glass Co., Ltd., and is formed to have a thickness of about 10 μm by applying such a paste by printing followed by the firing. An insulating glass formed by using PLS 3310, when thickness is 35 μm, exhibits an electrical insulation breakdown voltage as high as 2000 V under application of D.C. voltage. The insulating glass paste PLS 3310 is applied by printing after the formation of the heat generating resistor layer 102, followed by the firing.

The insulating glass layer 105 is applied not only to the web portion of the heat generating resistor layer 103 but also to cover the boundary between the electrode layer 104 and the web portion. A large temperature gradient is developed in the boundary between the web portion and the electrode forming portion 103 of the heat generating layer 102, posing a large risk of cutting in this boundary portion of the heat generating resistor layer 102. In the illustrated embodiment, the above-mentioned risk is averted by the provision of the insulating glass layer 105 which covers the boundary region. The insulating glass layer 105, which covers the boundary region between the web portion of the heat generating resistor layer 104 and the electrode layer 103, is effective also in preventing exfoliation of the electrode layer which tends to occur at the boundary due to infuluence of heat.

The surface of the insulating glass layer 105 is coated with a cover glass layer 106 made of a glassy material which has a low electrical insulation but exhibits a high degree of surface smoothness. The cover glass layer is made of a lead glass rich in lead oxide. For instance, a glass paste LS 207 produced by Tanaka Kinzoku International Co., Ltd. is glass layer of about 10 μm thick. The glass paste LS 207, when the layer thickness is 35 μm, exhibits a cmmparatively low level of electrical insulation breakdown voltage of 1500 to 1000 V under application of D.C. voltage, but has a surface smoothness Ra which is as small as 0.02 μm or less.

In contrast, the insulating glass layer 105 formed of PLS 3310 exhibits surface smoothness Ra of 1 to 2 μm. The insulating glass layer 105 cannot exhibit sufficiently high surface smoothness due to reasons such as inclusion of metal oxide fillers which are added for the purpose of enhancing electrical insulation power. The cover glass paste LS 207 is applied after the formation of the insulating glass layer 105, followed by the firing.

The fixing heater having such construction has two types of glass layers, i.e., the insulating glass layer 105 and the cover glass layer 106, which are intended for different functions. Consequently, these glass layers can satisfactorily achieve the functions required for the glass layer. Namely, abrasion of the heat generating resistor 102 is prevented by these glass layers and, in addition, the insulating glass layer 105 provides sufficiently high electrical insulation effect while the cover glass layer 106 improves slide of the copy paper sheets. If the required electrical insulation is to be produced by the cover glass layer alone, the thickness of the cover layer will be increased, resulting in a reduction in the heat transfer of the heat generating resistor 102. Such problem is avoided in the describe embodiment of the fixing heater. The provision of the cover glass layer 106 on the insulating glass layer 105 eliminates the problem of inferior sliding of the copy paper which otherwise is unavoidable when the insulating glass layer 105 is used alone without being covered by the cover glass layer 106.

Furthermore, according to the described method of the invention, the heat generating resistor layer 102, the insulating glass layer 105 and the cover glass layer 106 are successively formed, each employing application and firing of the paste, so that each glass layer can be formed without mixing together, thus ensuring that each layer performs its expected function.

Figure 13:
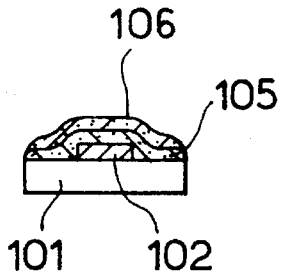
FIG. 13 is a sectional view taken along the line XIII—XIII of FIG. 11.
Figure 14:
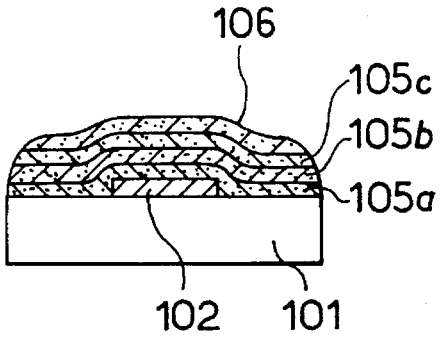
FIG. 14 is a sectional view similar to that of FIG. 13, but related to a modified embodiment of the present invention.

Another embodiment of this aspect of the present invention will be described with reference to FIG. 14. FIG. 14 is a sectional view of a second embodiment of the fixing heater in accordance with the present invention, corresponding to FIG. 13 illustrating the former embodiment. In this embodiment, the insulating glass layer is composed of three layers 105*a*, 105*b* and 105*c*. Other portions are the same as those of the former embodiment and detailed description relating to such same portions is omitted. The same reference numerals are used in FIG. 14 to denote the same parts as those in FIG. 13.

Each of the insulating glass layers 105*a*, 105*b* and 105*c* has the same glass composition as the first embodiment, and can be formed by the same method as that in the first embodiment. Namely, the insulating glass paste PLS 3310 is applied and fired to form each of the successive insulating glass layers.

The fixing heater as described provides the same advantages as those offers by the former embodiment. Namely, the abrasion of the heat generating resistor layer 102 is prevented, while high electrical insulating breakdown voltage and high degree of slide of copy paper sheets are attained by the insulating glass layer 105 and the cover glass layer 106, respectively.

In particular, the described method of producing fixing heater provides a higher level of electrical insulation breakdown voltage obtained with a given thickness of the insulating glass layer, due to the fact that the insulating glass layer is composed of a plurality of glass layers. Namely, since application and firing of the insulating glass layers are conducted a plurality of times, any pin hole which has been formed as a result of relief of gases during the firing of an underlying layer are covered by the paste of the next or overlying layer. Consequently, the final insulating glass layer composed of the laminate of glass layers has no pin hole which would extend throughout the insulating glass layer, thus preventing leak of electrical current which would otherwise be caused due to the presence of pin holes, whereby the electrical insulation of the fixing heater is improved.

The aforementioned three functions are satisfactorily achieved because two kinds of glass layers effectively prevent abrasion of the heat generating resistor and because these two types of glass layers share the required functions. Namely, the insulating glass layer provided sufficiently high electric insulation breakdown voltage, while the cover glass layer improved slide of the copy paper sheets.

According to the method of the present invention for producing a fixing heater, the heat generating resistor layer, the insulating glass layer and the cover glass layer are successively formed by applying and firing pastes, so that these layers can be formed without mixing each other, thus ensuring that each layer satisfactorily perform its own role.

It is to be understood that the present invention is not limited to the described embodiments and many other changes, modifications or combinations may be made without departing from the scopes of the appended claims.

What is claimed is:

1. A fixing heater comprising:

a substrate having an electrically insulative property;

an electrical resistance member including a heat generating portion formed on the substrate and extending in a longitudinal direction thereof, said heat generating portion having a pair of edge portions one of which is trimmed along the longitudinal direction;

electrode forming portions formed at both longitudinal end portions of the electrical resistance member; and at least two glass layers formed on a surface of the heat generating portion of the electrical resistance member, said at least two glass layers including a lowermost glass layer and an uppermost glass layer, said lowermost glass layer contacting the surface of the heat generating portion and having an electrical insulation effect higher than that of the uppermost glass layer, said lowermost glass layer also having a surface smoothness lower than that of the uppermost glass layer.

2. A fixing heater according to claim 1, wherein said at least two glass layers consist of an insulating glass layer and a cover glass layer.

3. A fixing heater according to claim 2, wherein said insulating glass layer is composed of a plurality of electrical insulating glass layer sections laminated on the surface of the heat generating portion, said insulating glass layer sections having a same composition.

4. A fixing heater according to claim 3, wherein said electrical resistance member comprises a film formed on the substrate.

5. A fixing heater according to claim 2, wherein said electrical resistance member comprises a film formed on the substrate.

6. A fixing heater according to claim 1, wherein said electrical resistance member comprises a film formed on the substrate.

7. A fixing heater comprising:

a substrate having an electrically insulative property;

an electrical resistance member including a heat generating portion formed on the substrate and extending in a longitudinal direction thereof, said heat generating portion having a pair of edge portions one of which is trimmed along the longitudinal direction;

electrode forming potions formed at both longitudinal end potions of the electrical resistance member; and a plurality of glass layers formed on a surface of the heat generating portion of the electrical resistance member, said glass layers including an uppermost glass layer and glass layers disposed below the uppermost glass layer, said uppermost glass layer having an electrical insulation effect lower than that of any one of said glass layers disposed below the uppermost glass layer, said uppermost glass layer also having a surface smoothness higher than that of any one of said glass layers disposed below the uppermost glass layer.

8. A fixing heater according to claim 7, wherein said electrical resistance member comprises a film formed on the substrate.

* * * * *